US006149324A

United States Patent [19]

Song

[11] Patent Number: 6,149,324

[45] Date of Patent: Nov. 21, 2000

[54] APPARATUS FOR SELECTIVELY REVERSING PAPER IN A PRINTER

[75] Inventor: Jin-hoan Song, Seoul, Rep. of Korea

[73] Assignee: Samsung Electronics Co., Ltd., Kyungki-do, Rep. of Korea

[21] Appl. No.: 09/358,728

[22] Filed: Jul. 22, 1999

[30] Foreign Application Priority Data

Jul. 22, 1998 [KR] Rep. of Korea ..... 98-29522

[51] Int. Cl.[7] ..... B41J 3/60

[52] U.S. Cl. ..... 400/188; 400/187; 271/65; 271/186

[58] Field of Search ..... 400/188, 189, 400/187, 186, 185; 271/3.14, 3.15, 3.17, 3.18, 3.19, 65, 185, 186, 81, 272, 302

[56] References Cited

U.S. PATENT DOCUMENTS

| | | | |
|---|---|---|---|
| 4,978,980 | 12/1990 | Noguchi et al. | 400/188 X |
| 5,133,541 | 7/1992 | Murasaki et al. | 271/186 X |
| 5,176,375 | 1/1993 | Kitahara | 271/272 X |
| 5,448,348 | 9/1995 | Azeta | 271/65 X |
| 5,690,325 | 11/1997 | Morimoto | 271/65 |

FOREIGN PATENT DOCUMENTS

| | | | |
|---|---|---|---|
| 2-291372 | 12/1990 | Japan | B65H 85/00 |
| 8-146830 | 6/1996 | Japan | G03G 21/00 |

*Primary Examiner*—John S. Hilten
*Assistant Examiner*—Minh H. Chau
*Attorney, Agent, or Firm*—Sughrue, Mion, Zinn, Macpeak & Seas, PLLC

[57] ABSTRACT

A paper reversing apparatus of a printer includes a printing medium exhaust path which is connected between an outlet of a printing unit and an outside of a printer main body to guide exhaustion of a printing medium. A guide unit selectively guides a leading edge of the printing medium passing the printing unit to enter one of the printing medium exhaust path or a reversing path, which is branched from the printing medium exhaust path. The printing medium exhausted to the reversing path is reversed and re-supplied to an inlet side of the printing unit. A paper resupply unit is installed between an inlet of the entrance path and an outlet of the reversing path, and is capable of pivoting. Paper detection sensors are installed at the inlet of the entrance path for detecting a type of printing medium entering the entrance path. Thus, when a printing medium in the form of a transparent overhead projector sheet enters into the entrance path, the sheet is detected by the sensors and only one side of the sheet is printed on before the sheet is exhausted out of the printer main body, without unnecessarily applying developer to both sides of the transparent sheet.

9 Claims, 3 Drawing Sheets

APPARATUS FOR SELECTIVELY REVERSING PAPER IN A PRINTER

BACKGROUND OF THE INVENTION

1. Field of the Invention

The present invention relates to a printer, and more particularly, to a paper reversing apparatus of a printer having an improved structure so that printing in a "print both sides" mode is prevented when a printing medium to be printed on is a transparent sheet such as an overhead projector (OHP) sheet.

2. Description of the Related Art

In a conventional printer or copier capable of printing on both sides of a paper, there is a paper reversing apparatus for reversing the paper after one side has been printed on and supplying the reversed paper in sequence back to a printing unit.

A significant disadvantage of implementing a reversing apparatus according to the conventional printer or copier is that an image can be erroneously printed on both sides of an OHP sheet while the printer is in a "both sides print" mode. Since the OHP sheet is transparent, the OHP sheet having both sides printed on cannot be used, thus wasting developer and the OHP sheet.

SUMMARY OF THE INVENTION

To solve the above problem, it is an objective of the present invention to provide a paper reversing apparatus of a printer having an improved structure so that printing on both sides of a printing medium is prevented when the printing medium to be printed on is an overhead projector (OHP) sheet.

Accordingly, to achieve the above objective, there is provided a paper reversing apparatus of a printer for reversing a paper having one side printed and re-supplying the paper to a printing unit provided in a main body of the printer where an entrance path is provided near an inlet of the printing unit so that an image can be printed on the other side of the paper. The apparatus comprises a printer unit having an entrance path for receiving a printing medium to be printed on and an outlet side for exhausting the printing medium. A printing medium exhaust path is connected to the outlet side of the printing unit for guiding the exhaustion of the printing medium. A reversing path is branched from the printing medium exhaust path for reversing the printing medium and re-supplying the reversed printing medium to the entrance path of the printing unit. A guide means is provided for selectively guiding a leading edge of the printing medium passing the printing unit to enter either the printing medium exhaust path or the reversing path. A paper resupply means is installed between an inlet of the entrance path and an outlet of the reversing path wherein the paper resupply means is capable of pivoting. A paper detection sensor is positioned proximate to the entrance path for detecting the type of printing medium entering the entrance path, wherein, when the printing medium is a transparent overhead projector (OHP) sheet, the guide means is operative to exhaust the sheet through the printing medium exhaust path.

It is preferred in the present invention that the paper detection sensor is operative when a "print both sides" command is ordered.

It is preferred in the present invention that the paper resupply means comprises a pair of pickup rollers, installed to be operative to pivot so as to be selectively aligned with the outlet of the reversing path or the inlet of the entrance path, for supplying the printing medium to the entrance path while selectively rotating in a forward or reverse direction.

It is preferred in the present invention that the paper resupply means comprises a shaft operative to be rotated in a forward or reverse direction by a driving source. A first gear unit is provided at an end of the shaft and a second gear unit is coupled to one of the pickup rollers. A pair of brackets support the pickup rollers and the shaft, wherein the pair of brackets are operative to pivot. An idle gear is installed on one of the brackets for transferring a rotational force of the first gear unit to the second gear unit and a frictional member is fixed to one of the pair of brackets and frictionally coupled to the idle gear. A first and second stopper is positioned on the printer main body for limiting the range of pivot of the pair of brackets, wherein, when the first gear unit of the shaft rotates in a forward or reverse direction, the pair of brackets pivot due to a frictional force between the idle gear and the frictional member so that the pickup rollers are selectively aligned with the outlet of the reversing path and the inlet of the entrance path and, when the pair of brackets are stopped by the stoppers, the idle gear rotates overcoming the frictional force so that the rotational force is transferred to the second gear unit.

It is preferred in the present invention that the guide means comprises a pivot plate installed to be operative to pivot at the reversing path for guiding a leading edge of the printing medium passing the printing unit to enter either the printing medium exhaust path or the reversing path, and an actuator for pivoting the pivot plate.

BRIEF DESCRIPTION OF THE DRAWINGS

The above objective and advantages of the present invention will become more apparent by describing in detail a preferred embodiment thereof with reference to the attached drawings in which:

FIGS. 2 through 4 are views for explaining the operation of the paper reversing apparatus shown in FIG. 1, in which FIG. 2 shows a first paper supply state; FIG. 3 shows a paper reversing state; and FIG. 4 shows a paper resupply state.

DETAILED DESCRIPTION OF THE INVENTION

Figure 1:
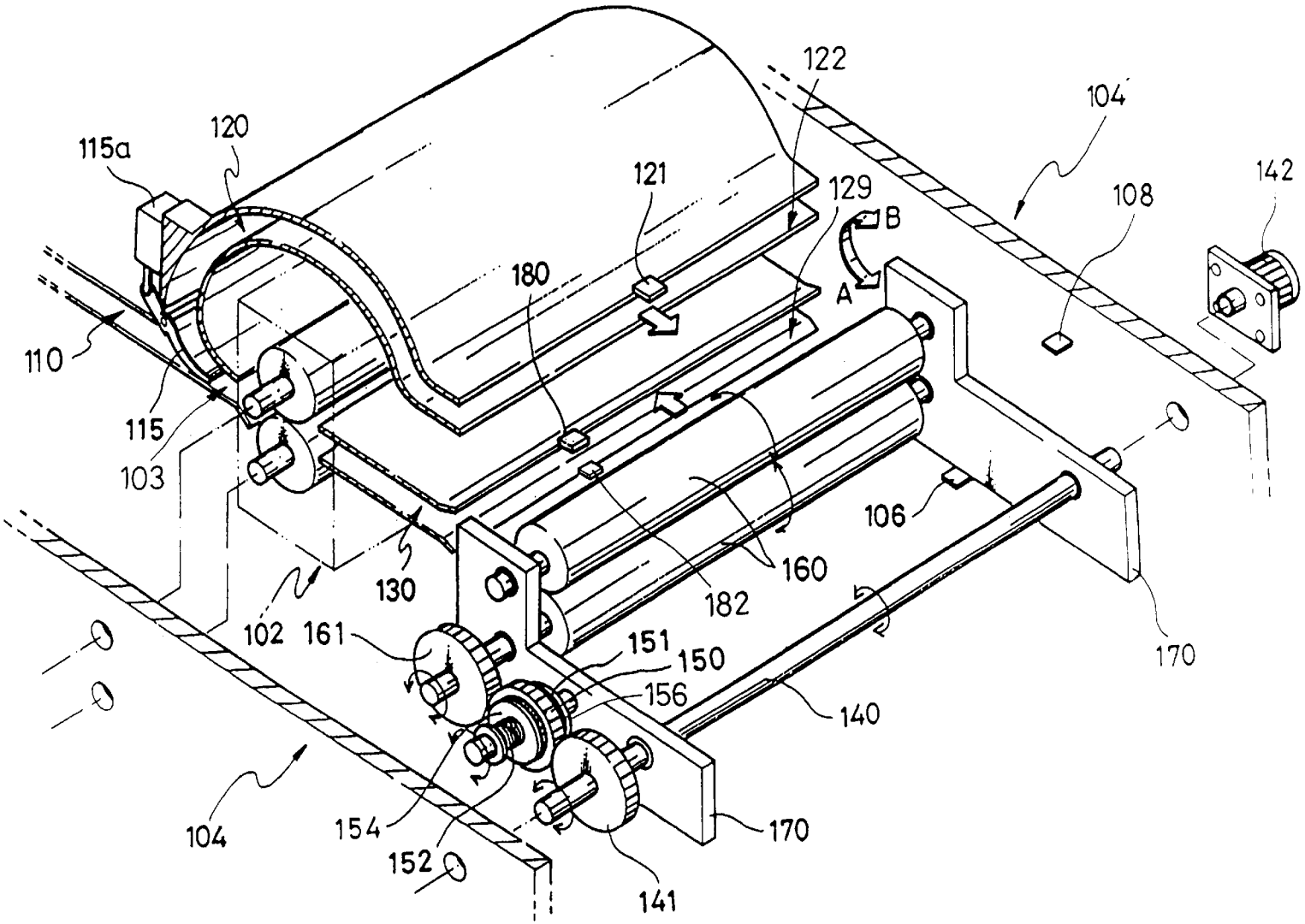
FIG. 1 is a perspective view showing a paper reversing apparatus of a printer according to a preferred embodiment of the present invention.

Referring to FIG. 1, in the paper reversing apparatus of a printer according to a preferred embodiment of the present invention, a printing medium exhaust path 110 connects an outlet side 103 of a printing unit 102 and the outside of a printer main body (not shown). A reversing path 120 is branched out from the printing medium exhaust path 110. A guide means is installed at the point where the reversing path 120 branches out from the printing medium exhaust path 110. A paper resupply means is installed to be operative to pivot between an inlet 129 of an entrance path 130 and an outlet 122 of the reversing path 120, and paper detection sensors 180 and 182 are installed at the inlet 129 of the entrance path 130 for detecting the type of printing medium, such as a piece of paper or a transparent overhead projector (OHP) sheet, entering the entrance path 130.

The printing medium exhaust path 110 guides a printing medium which is to be exhausted out of the printer main body. The reversing path 120 reverses paper that has passed through the printing unit 102 and guides the reversed paper to an inlet side of the printing unit 102.

The guide means guides a leading edge of the printing medium as the printing medium passes through an outlet side 103 of the printing unit 102 to enter either the printing medium exhaust path 110 or the reversing path 120. The guide means is comprised of a pivot plate 115 and an actuator 115*a* such as a solenoid, coupled to one side of the pivot plate 115. In the present invention, the pivot plate 115 is installed to be capable of pivoting at the reversing path 120 and guides the leading edge of the printing medium as it passes through the printing unit 102 to enter one of the printing medium exhaust path 110 or the reversing path 120.

The paper resupply means includes a shaft 140, an idle gear 150, a pair of pickup rollers 160, and a pair of brackets 170. The paper resupply means pivots between the inlet 129 of the entrance path 130 and the outlet 122 of the reversing path 120 and is capable of selectively rotating in a forward or reverse direction. The paper resupply means feeds a printing medium to be printed on to the printing unit 102 through the entrance path 130 or draws the reversed paper coming out of the reversing path 120 and re-supplies the reversed paper to the printing unit 102.

The shaft 140 is installed at the inlet side of the printing unit 102 and is rotated by a motor 142 in a forward or reverse direction. A first gear unit 141 is coupled at one end of the shaft 140. The pickup rollers 160 rotate in close contact with one another and transfer the printing medium. A second gear unit 161 is installed at one end of the pickup rollers 160 for creating a power connection with the first gear unit 141. The pickup rollers 160 and the shaft 140 are rotatably supported by the pair of brackets 170. The first and second gear units 141 and 161 are responsive to each other due to being connected by the idle gear 150 so that power can be transmitted. A friction member 151, such as felt, is interposed between the idle gear 150 and a shaft portion 156 which protrudes from one of the pair of brackets 170. The friction member 151 and a friction portion 154 are elastically pressed to each other by a spring 152, such that the idle gear 150 is in a state in which rotation thereof is prevented due to a friction force applied by the friction member 151. Thus, when the shaft 140 is rotated, the idle gear 150 and the pair of brackets 170 pivot integrally in a direction A or B. That is, the pickup rollers 160 use the shaft 140 as a hinge axis to selectively pivot between the outlet 122 of the reversing path 120 and the inlet 129 of the entrance path 130.

The paper detection sensors 180 and 182 are operated by a controller (not shown) when a "print both sides" mode is activated. In the "print both sides" mode, the paper detection sensors 180 and 182 detect whether a printing medium entering the entrance path 130 is an opaque piece of paper or a transparent OHP sheet by emitting light from one side of the entrance path 130 to the opposite side thereof. If the printing medium to be printed on is determined to be an OHP sheet, information about the OHP sheet is transmitted to the controller and the controller operates the guide means to exhaust the OHP sheet after an image has been printed on only one side of the OHP sheet. Specifically, the pivot plate 115 which blocks the printing medium exhaust path 110 by contacting a lower plate of the printing medium exhaust path 110, pivots such that it contacts a lower plate of the reversing path 120, thus blocking the reversing path 120. As a result, the OHP sheet in the entrance path 130 does not enter the reversing path 120 and is exhausted through the printing medium exhaust path 110 after leaving the printing unit 102. Reference numeral 104 denotes a part of an inside wall of the printer main body; reference numerals 106 and 108 denote first and second stoppers, respectively, which are formed on the inside wall 104. The stoppers 106 and 108 are positioned to stop the pair of brackets 170 at a predetermined position so that the pickup rollers 160 are aligned with either the entrance path 130 or the reversing path 120. Reference numeral 121 denotes a sensor for detecting the leading edge of the paper exiting the reversing path 120.

The operation of the paper reversing apparatus of a printer having the above structure will be described with reference to FIGS. 2 through 4.

Figure 2:
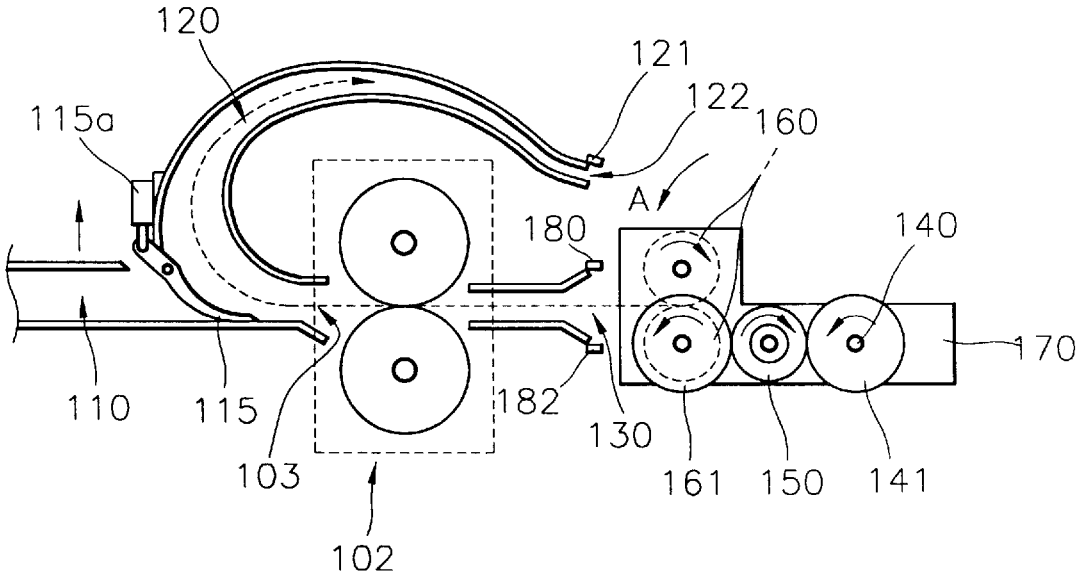

As shown in FIG. 2, when a command is given to perform printing in a "print both sides" mode, the printing medium included in a paper tray cassette (not shown) is supplied toward the entrance path 130 and the paper detection sensors 180 and 182 operate according to the "print both sides" command. The paper detection sensors 180 and 182 determine whether the printing medium supplied is a transparent OHP sheet or an opaque piece of paper. If the printing medium is determined to be an opaque piece of paper by the detection sensors 180 and 182, the shaft 140 is rotated by the motor 142 counterclockwise. In doing so, the first gear unit 141 tries to rotate the idle gear 150 engaged thereto, but the idle gear 150 does not rotate because the idle gear 150 is prevented from rotating due to the frictional force applied by the friction member 151. Consequently, as the first gear unit 141 rotates, the shaft acts as a hinge axis so that the idle gear 150 and the pair of brackets 170 pivot integrally in a direction A. The pivoting of the pair of brackets 170 is brought to a stop by the first stopper 106.

The first gear unit 141 continues to apply a rotational force to the idle gear 150 and overcomes the frictional force applied by the friction member 151, thus, the rotational force of the first gear unit 141 is transmitted to the pickup rollers 160 via the second gear unit 161, so that the pickup rollers 160 rotate. When the pivoting of the pair of brackets 170 is stopped by the first stopper 106, the pickup rollers 160 and the entrance path 130 are aligned so that the paper supplied from the cassette can enter the entrance path 130. The paper supplied from the cassette or a manual feed tray then enters the entrance path 130 by being caught and drawn by the pickup rollers 160 and an image is printed on one side of the paper by the printing unit 102. As a result of the paper being opaque, the pivot plate 115 is pivoted clockwise by the solenoid 115*a* to block the printing medium exhaust path 110. Thus, the paper passing the printing unit 102 is guided to the reversing path 120 along the pivot plate 115 in the direction indicated by a dashed arrow.

Figure 3:
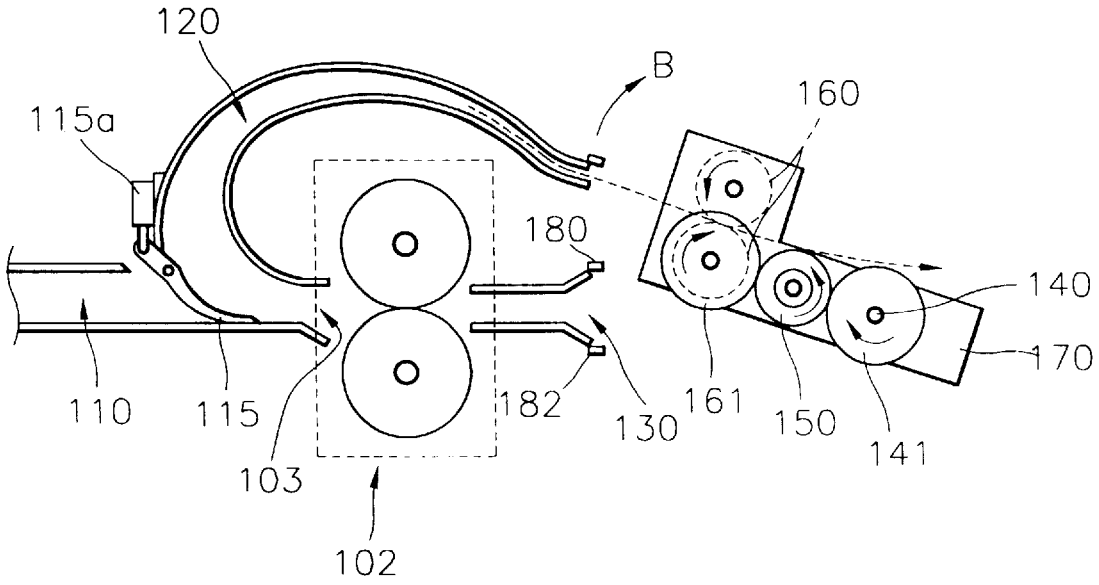

When the trailing edge of the paper completely passes the pickup rollers 160, the shaft 140 is rotated clockwise, as shown in FIG. 3, and the first gear unit 141 tries to rotate the idle gear 150 counterclockwise. Since the idle gear 150 is in a state in which the rotation thereof is stopped due to the frictional force applied by the friction member 151, the pair of brackets 170 pivot in a direction B until the pair of brackets 170 are stopped by the second stopper 108. The first gear unit 141 continues to apply a rotational force to the idle gear 150 which overcomes the frictional force of the friction member 151. Accordingly, the pickup rollers 160 connected to the idle gear 150 rotate. The paper passing the reversing path 120 is caught by the pickup rollers 160 and exits as indicated by a dashed arrow, in a reversed state. That is, the side of the paper with the printed image is turned upside down with reference to the paper's position while originally in the printing unit 102. The paper exiting the reversing path 120 can be detected by counting the number of rotations of a motor (not shown) which drives the printing unit 102. However, in the preferred embodiment of the present invention, the sensor 121 installed at the outlet 122 of the reversing path 120 detects the paper.

Figure 4:
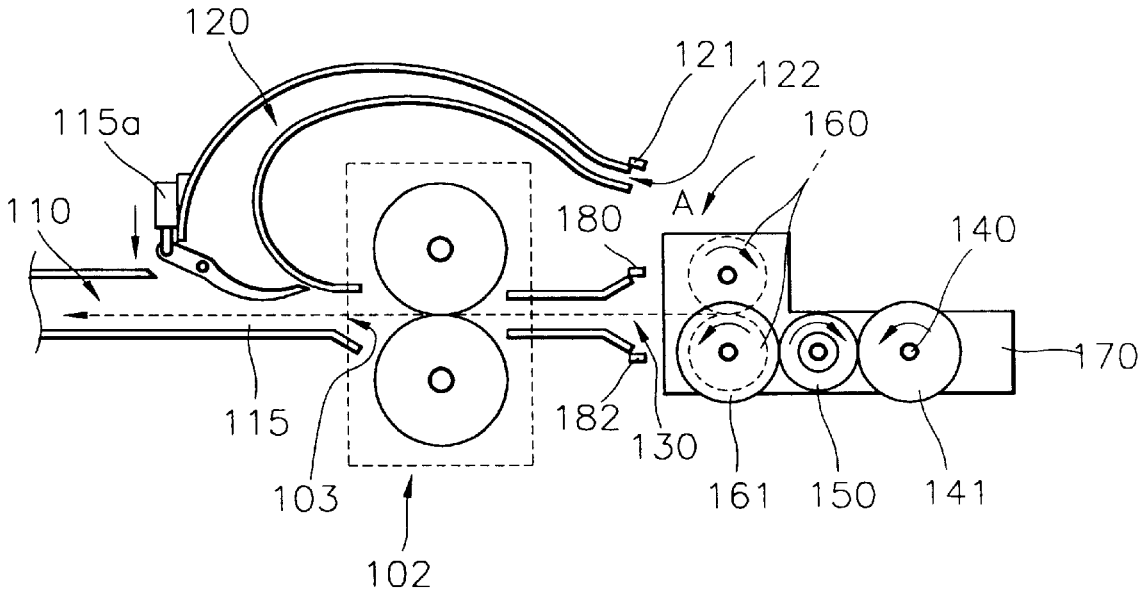

As shown in FIG. 4, when the paper is detected to completely come out from the reversing path 120, the shaft 140 rotates counterclockwise and the pair of brackets 170 pivot in a direction A. Thus, when the pickup rollers 160 and the entrance path 130 are aligned, the pickup rollers 160 rotate so that the paper can enter the entrance path 130. Then, the paper having both sides reversed is resupplied to the printing unit 102 and the side of the paper which does not have print, is now printed on by the printing unit 102. The pivot plate 115 pivots counterclockwise by the solenoid 115*a* to open the printing medium exhaust path 110 and the paper which was re-supplied to the printing unit 102 is now exhausted out of the printer main body through the printing medium exhaust path 110.

However, the above printing process describes a "print both sides" mode using an opaque paper. When the printing medium contained in the cassette is a transparent OHP sheet and a user orders a "print both side" command in such a state, the paper detection sensors 180 and 182 detect that the printing medium entering the entrance path 130 is the transparent OHP sheet. Then, in spite of the "print both sides" command, the controller, as shown in FIG. 4, closes the reversing path 120 by operating the solenoid 115*a* to allow the pivot plate 115 to pivot counterclockwise so that the printing medium exhaust path 110 is open. Thus, in spite of a "print both sides" command, only one side of the OHP sheet is printed on before the sheet is exhausted out of the printer main body.

As described above, in the paper reversing apparatus of a printer according to the present invention, to prevent erroneous printing on both sides of an OHP sheet, in a "print both sides" mode, the printing medium entering the entrance path is detected by the paper detection sensors and, when the printing medium is an OHP sheet the "print both sides" command is overridden, thus, only one side of the sheet is printed on and the sheet is exhausted out of the printer main body.

It is contemplated that numerous modifications may be made to the apparatus of the present invention without departing from the spirit and scope of the invention as defined in the claims.

What is claimed is:

1. A paper reversing apparatus of a printer, said apparatus comprising:

a printer unit having an entrance path for receiving a printing medium to be printed on and an outlet side for exhausting the printing medium;

a printing medium exhaust path connected to said outlet side of said printing unit for guiding the exhaustion of the printing medium;

a reversing path branched from said printing medium exhaust path for reversing the printing medium and re-supplying the reversed printing medium to said entrance path of said printing unit;

a guide means for selectively guiding a leading edge of the printing medium passing said printing unit to enter either said printing medium exhaust path or said reversing path;

a paper resupply means installed between an inlet of said entrance path and an outlet of said reversing path, and pivoting there between; and a paper detection sensor positioned proximate to said entrance path for detecting a type of the printing medium entering said entrance path, wherein, when the printing medium is a transparent overhead projector sheet, said guide means is operative to exhaust said sheet through said printing medium exhaust path.

2. The apparatus as claimed in claim 1, wherein said paper detection sensor is operative when a "print both sides" command is ordered.

3. The apparatus as claimed in claim 2, wherein said paper resupply means comprises a pair of pickup rollers, installed to be operative to pivot so as to be selectively aligned with the outlet of said reversing path or the inlet of said entrance path, for supplying the printing medium to said entrance path while selectively rotating in a forward or reverse direction.

4. The apparatus as claimed in claim 2, wherein said guide means comprises:

a pivot plate installed to be operative to pivot at said reversing path for guiding a leading edge of said printing medium passing said printing unit to enter either said printing medium exhaust path or said reversing path; and an actuator for pivoting said pivot plate.

5. The apparatus as claimed in claim 1, wherein said paper resupply means comprises a pair of pickup rollers, installed to be operative to pivot so as to be selectively aligned with the outlet of said reversing path or the inlet of said entrance path, for supplying the printing medium to said entrance path while selectively rotating in a forward or reverse direction.

6. The apparatus as claimed in claim 5, wherein said paper resupply means comprises:

a shaft operative to be rotated in a forward or reverse direction by a driving source;

a first gear unit provided at an end of said shaft;

a second gear unit coupled to one of said pickup rollers;

a pair of brackets supporting said pickup rollers and said shaft, wherein said pair of brackets are operative to pivot;

an idle gear installed on one of said pair of brackets for transferring a rotational force of said first gear unit to said second gear unit;

a frictional member fixed to said one of said pair of brackets and frictionally coupled to said idle gear; and a first and second stopper positioned on the printer main body for limiting the range of pivot of said pair of brackets, wherein, when said first gear unit of said shaft rotates in a forward or reverse direction, said pair of brackets pivot due to a frictional force between said idle gear and said frictional member so that said pickup rollers are selectively aligned with either said outlet of said reversing path or the inlet of said entrance path and, when said pair of brackets are stopped by one of said first or second stoppers, said idle gear rotates overcoming the frictional force so that the rotational force is transferred to said second gear unit.

7. The apparatus as claimed in claim 1, where in said paper detection sensor is installed at an inlet of said entrance path.

8. The apparatus as claimed in claim 1, wherein said guide means comprises:

a pivot plate installed to be operative to pivot at said reversing path for guiding a leading edge of the printing medium passing said printing unit to enter either said printing medium exhaust path or said reversing path; and an actuator for pivoting said pivot plate.

9. A paper reversing apparatus of a printer, said apparatus comprising:

a printer unit having an entrance path for receiving a printing medium and an outlet side for exhausting the printing medium;

a printing medium exhaust path connected to said outlet side of said printing unit for guiding the exhaustion of the printing medium;

a reversing path branched from said printing medium exhaust path for reversing the printing medium and re-supplying the reversed printing medium to said entrance path of said printing unit;

a pivot plate positioned between said printing medium exhaust path and said reversing path for guiding a leading edge of the printing medium passing said printing unit to enter either said printing medium exhaust path or said reversing path;

a pair of pickup rollers pivoting so as to be selectively aligned with the outlet of said reversing path or the inlet of said entrance path, for supplying the printing medium to said entrance path while selectively rotating in a forward or reverse direction; and a paper detection sensor positioned proximate to said entrance path for detecting a type of the printing medium entering said entrance path, wherein, when the printing medium is a transparent overhead projector sheet, said pivot plate is operated to exhaust the sheet through said printing medium exhaust path.

* * * * *